United States Patent [19]

Peek

[11] Patent Number: 4,575,088

[45] Date of Patent: Mar. 11, 1986

[54] THREE DIMENSIONAL COMBINATORIAL DEVICE

[76] Inventor: Darwin E. Peek, 853 Maske Rd., Schertz, Tex. 78154

[21] Appl. No.: 370,566

[22] Filed: Apr. 21, 1982

[51] Int. Cl.[4] ..... A63F 9/08

[52] U.S. Cl. ..... 273/153 S

[58] Field of Search ..... 273/153 S, 155; 434/215

[56] References Cited

U.S. PATENT DOCUMENTS

| | | | |
|---|---|---|---|
| 4,473,228 | 9/1984 | Hart | 273/153 S |
| 4,474,376 | 10/1984 | Gustafson | 273/153 S |
| 4,506,891 | 3/1985 | Alexander et al. | 273/153 S |

FOREIGN PATENT DOCUMENTS

| | | | |
|---|---|---|---|
| 42695 | 12/1981 | European Pat. Off. | 273/153 S |
| 81043821 | 7/1981 | Fed. Rep. of Germany | 273/153 S |
| 2405077 | 5/1979 | France | 273/153 S |
| 55-8193 | 3/1980 | Japan | 273/153 S |

OTHER PUBLICATIONS

Buckingham Toys Brochure, 1 page, Jan. 1, 1982.

*Primary Examiner*—Anton O. Oechsle

*Attorney, Agent, or Firm*—Gunn, Lee & Jackson

[57] ABSTRACT

A combinatorial device especially adopted as a teaching aid in the study of finite, non-Abelian permutation groups. The invention structurally utilizes a central core member having a multiplicity of supporting members extending outwardly from the core member. Further, a multiplicity of face pieces are slidably interlocked with the support members such that a transitive permutation group is generated by varying the orientation of a multiplicity of the face pieces, having a common junction, about the core member.

11 Claims, 16 Drawing Figures

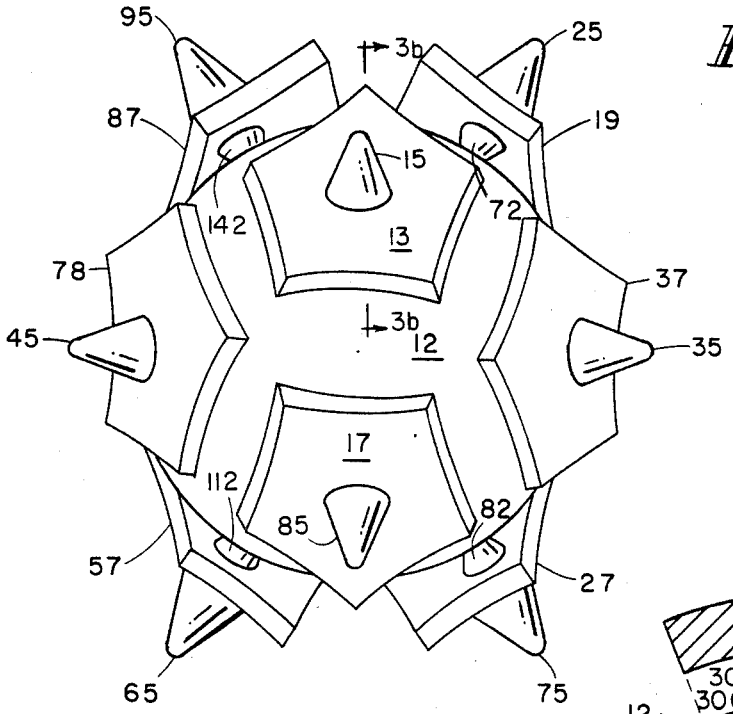
FIG. 3a
FIG. 3b
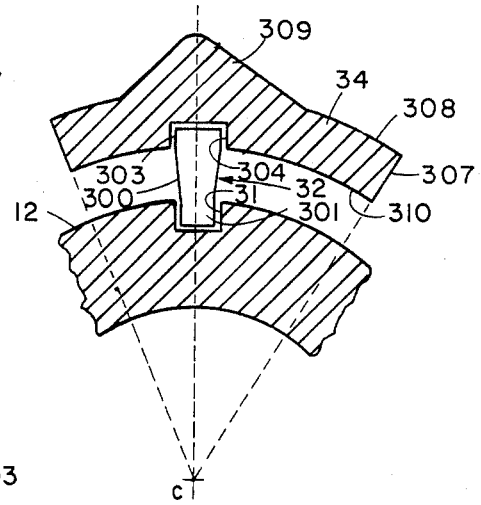
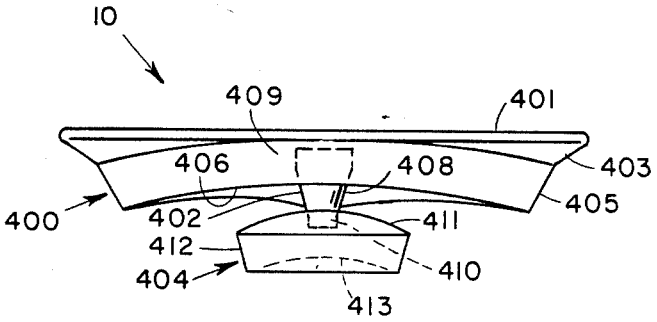
FIG. 4a
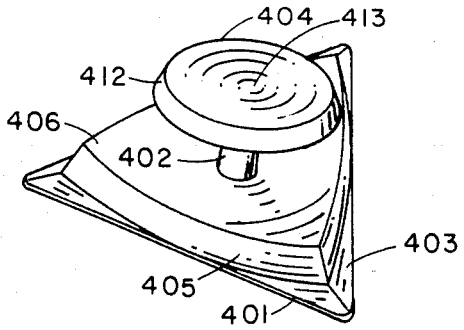
FIG. 4b
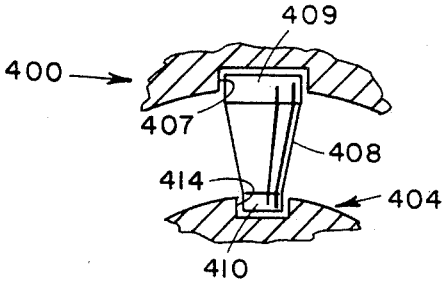
FIG. 4c FIG. 6f
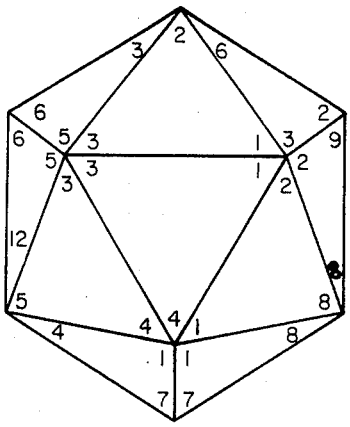
FIG. 6c
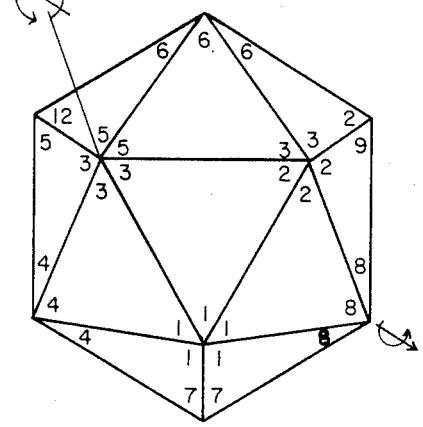
FIG. 6d
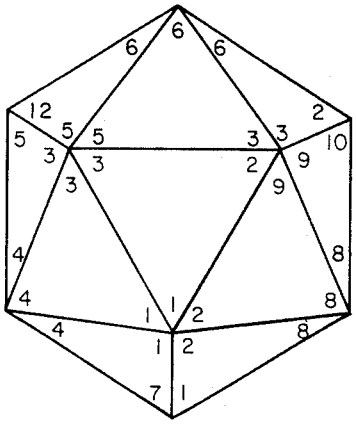
FIG. 6b
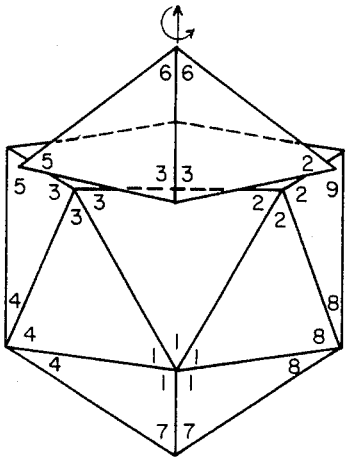
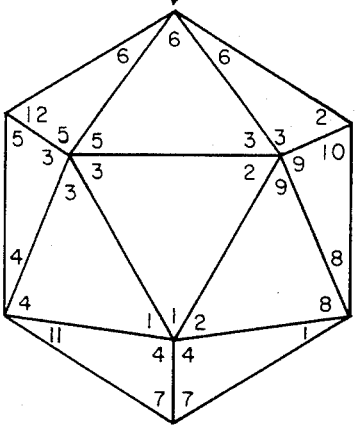
FIG. 6e
FIG. 6a
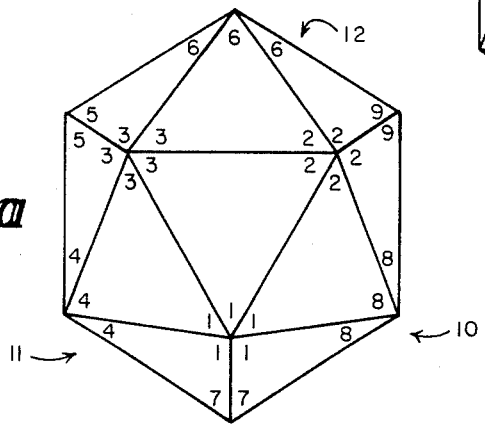

THREE DIMENSIONAL COMBINATORIAL DEVICE

BACKGROUND OF THE INVENTION AND PRIOR ART

This invention relates to a novel combinatorial device which provides increased educational opportunities in the study of combinatorics, as well as a pastime novelty device for those simply seeking a more mentally challenging novelty. Specifically, the present invention is to a twenty-sided regular polyhedron known as an icosahedron.

Regular polyhedra are uniform (all of its vertices are the same or congruent) and have faces of all of one kind of congruent regular polygon. There are five regular polyhedra. The regular polyhedra were an important part of Plato's natural philosophy, and thus have come to be called the Platonic Solids. These five regular polyhedra are the tetrahedron, the cube, the octahedron, the dodecahedron, and the icosahedron.

A semiregular polyhedron has regular polygons as faces, but the faces are not of the same kind. As in regular polyhedra, the vertices are congruent. There are thirteen semiregular polyhedra. It is generally believed that they were described by Archimedes, and thus are called the Archimedean Polyhedra.

The "Magic Cube", also known as "Rubik's Cube", has offered the mathematics, architectural, computer, and puzzle world with the most imaginative and challenging combinatorial device since Sam Loyd's famous 14/15 Puzzle which came out in the 19th century. Structurally, the "Magic Cube" is formed by three types of cube members: six center cubes, twelve edge cubes, and eight corner cubes. The center cubes have only one face portion which is involved in the numerous orientations possible in the device. However, the edge cubes have two such face portions, and the corner cubes have three such face portions. The six center cubes are attached to axles which issue from a central spindle. Each of the other cube members has small projections or ledges which interlock with other cube members; the center cubes act as keystones.

Following the initial commercial success of the "Magic Cube," a number of variations of this basic device were developed. Structurally, these variations were nearly identical to that described above. By retaining the same structural construction, assurance that the device would operate was provided. To achieve one of the variations, for example, the edges of the "Magic Cube" were cut off, yielding a truncated cube now having a total of fourteen faces rather than the six faces of an original cube. In the original "Magic Cube" the six faces were each square; in the truncated cube, there are eight triangular faces and six octagonal faces. Thus, the truncated cube is a semiregular polyhedron. In the original cube there were eight vertices, each with three edges meeting; in the truncated cube there are twentyfour vertices, each having three edges meeting. Other variations to the "Magic Cube" include removing all edges and forming a sphere, or rounding four sides and forming a cylinder.

SUMMARY OF THE PRESENT INVENTION

The present invention is a combinatorial device especially adapted as a teaching aid in the study of finite, non-Abelian permutation groups. With the "Magic Cube" and its present variations, the structure of the device remains the same; and, thus, the mathematical solution to the variations are the same as for the cube. The present invention has a different mathematical solution and considerable differences in structure. Each triangular face piece in the present invention is interchangeable with any other face piece; this is not the case with the cube or its variations. Thus, the group generated by the preferred embodiment of the present invention is a transitive permutation group while the cube and its variations are non-transitive. The solution to the "transitive" device of the present invention is considerably different than the "non-transitive" cube.

Further the "Magic Cube" has four primary rotational moves at each of six locations for a total of twenty-four primary moves. The present invention has five primary rotational moves at each of twelve locations for a total of sixty primary moves. In other words, the manipulator of the present invention has sixty options versus twenty-four options with the cube, or its variations, at any point in the manipulation of the present invention through its various orientations.

Structurally, the present invention utilizes a central core member having a multiplicity of supporting members extending outwardly from the core member. The support members do not form a part of the transitive permutation group. The groupings are developed by varying the orientation of a multiplicity of face pieces about the core member. The face pieces are slidably interlocked with the support members. In the preferred embodiment, discussed in greater detail hereinafter, any five of the face pieces having a common junction may be rotated about the core member as a single unit.

The incredible magnitude of possible permutations available with the present invention makes it especially suited for teaching combinatorics. It is an object of the present invention to provide a teaching aid in this area of mathematics.

It is another object of the present invention to provide a novel puzzle for entertainment purposes.

It is yet another object of the present invention to provide a means for improving finger dexterity by manipulation of the present invention through its various permutations.

BRIEF DESCRIPTION OF THE DRAWINGS

FIG. 3*a* is a perspective view of the core member and support members of the preferred embodiment of the device with the face pieces removed.

FIG. 3*b* is a section view of support member 13 shown in FIG. 3*a* along section line 3*b*—3*b*.

FIG. 4*a* is a side view of face piece 10 of the preferred embodiment of the device.

FIG. 4*b* is a perspective view of face piece 10 of the preferred embodiment of the invention in an inverted position.

FIG. 4*c* is a detailed view of a portion of face piece 10 of the preferred embodiment of the invention showing shaft member 408.

FIG. 6*a* thru 6*f* are diagramatic drawings of the operation of the preferred embodiment of the invention through various orientations.

DETAILED DESCRIPTION OF PREFERRED EMBODIMENT

Figure 1:
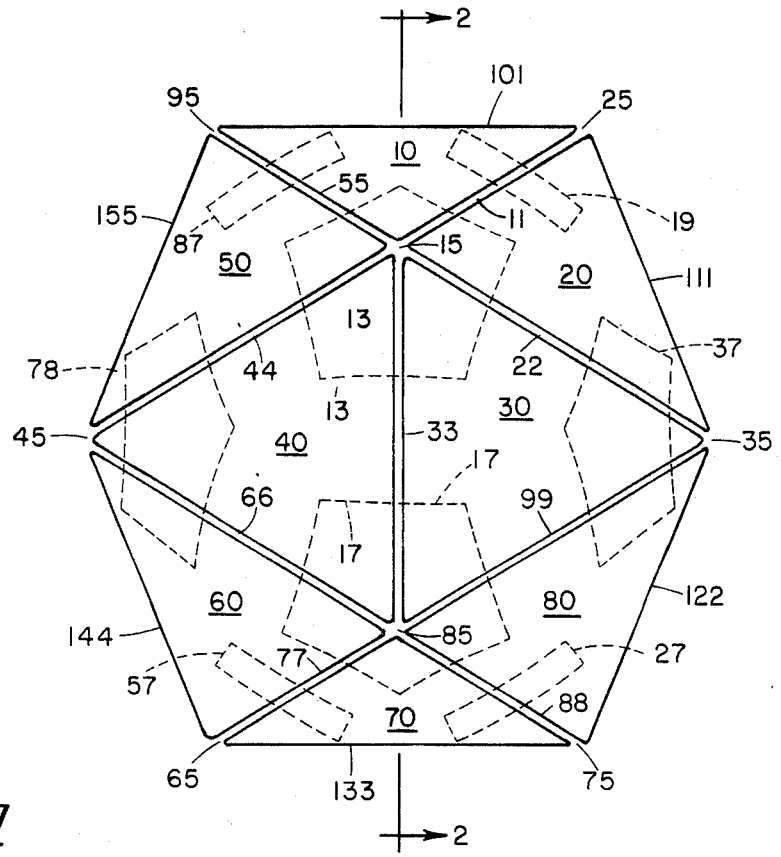
FIG. 1 is a view of the perferred embodiment of the device showing the support members in broken lines.

FIG. 1 shows the preferred embodiment of the present invention completely assembled with portions below the surface shown in broken lines. The preferred embodiment of the invention has twenty identically sized, slidably movable, triangular face pieces. FIG. 1 shows eight such faces 10, 20, 30, 40, 50, 60, 70, and 80. There are thirty edges on the preferred embodiment of the invention, with fifteen such edges appearing in FIG. 1 referred numerals 11, 22, 33, 44, 55, 66, 77, 88, 99, 101, 111, 122, 133, 144, and 155. There are twelve vertices on the preferred embodiment of the invention and FIG. 1 shows eight such vertices, 15, 25, 35, 45, 65, 75, 85, and 95.

Figure 2:
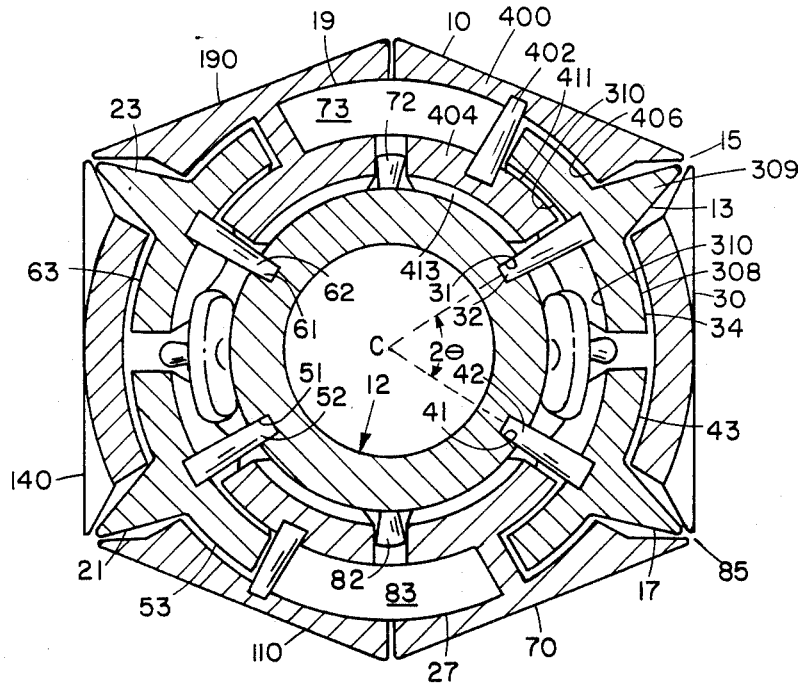
FIG. 2 is a cross section view along line 2—2 of the preferred embodiment of the device shown in FIG. 1.

FIG. 2 shows a cross-section of the preferred embodiment along line 2—2. Face pieces 10, 30, 70, 110, 140, and 190 are shown in FIG. 2. FIG. 2 also reveals support members 13, 17, 19, 21, 23, and 27. There are a total of twelve support members in the preferred embodiment of the invention. As will be discussed hereinafter in more detail, the support members provide support for the face pieces during movement from one orientation to another and also serve to interlock the face pieces within the overall invention.

Further, FIG. 2 shows the core member 12. In the preferred embodiment, the core member is spherical in shape to provide additional structural support, but other structural shapes and even spindles or a combination thereof are envisioned. Spherical core member 12 can be a hollow shell as shown in FIG. 2, or solid, depending upon construction preference. Core member 12 has twelve radial bores in its outer surface. Four such core bores 31, 41, 51, and 61 are seen in FIG. 2. Set in each core bore and extending radially from core member 12 are the twelve support members. Each support member is attached to the core member 12 by conically shaped rods. Each rod is of equal length. The angle between any two rods, measured from the center C of core member 12 is designated $2\theta$ and is approximately 63° in the preferred embodiment. Six such rods 32, 42, 52, 62, 72, and 82 are seen in FIG. 2.

Mounted on the top of each rod is an arcuated cap member. FIG. 2 shows cap members 34, 43, 53, 63, 73, and 83.

FIG. 3*a* is a perspective illustration of the core member 12 with support members 13, 17, 19, 27, 37, 57, 78 and 87 extending radially from the core 12. As can be seen from FIG. 3*a* each rod member shown, 72, 82, 112, and 142, is equidistant from all adjacent rods and each rod is of the same length.

FIG. 3*b* is a cross-sectional detailed plan view of support member 13 along line 3*b*–3*b* of FIG. 3*a*. Rod 32 has a generally conically shaped middle portion 300, a generally cylindrical rod bottom portion 301, and a generally cylindrical rod top portion 303. Rod bottom portion 301 is sized to fit securely into core bore 31 and may be secured by a press fit or by appropriately threading rod bottom portion 301 and core bore 31. Rod top portion 303 is sized to fit securely into cap bore 304 in cap 34 and may be secured by a press fit or by appropriately threading rod top portion 303 and cap bore 304.

Cap member 34 has a generally pentagonally shaped brim portion 307 with each vertex or corner of each brim portion orientated at a vertex or corner of two adjacent brim portions as can be seen in FIG. 3*a*. Cap 34 also has a cap peak portion 309 for ensuring that the face pieces remain in the proper spatial relationship to the core member and each other. The cap peak portions are situated such that they are located beneath the twelve vertices when the preferred embodiment of the device is in its original or pristine orientation. Cap brim portion 307 is arcuated and the radius of curvature of such arc will be discussed hereinafter more fully.

Referring again to FIG. 2, and more specifically to face piece 10, it can be seen that face piece 10 has three main components; a body section 400, a generally conical shaft 402, and an arcuated base 404.

Detailed construction of face piece 10 can be seen in FIG. 4*a*. Using face pieces 10 as an example for all face pieces of the preferred embodiment of the invention, it will be noted in FIG. 4*a* that body member 400 of face piece 10 has a triangular surface 401, a beveled lip 403, an arcuated shoulder 405, and an arcuated body underside 406.

Arcuated base 404 has an arcuated base top 411, a base side 412, and an arcuated base underside 413.

Conical shaft 402 has a generally conically shaped middle portion 408, a generally cylindrical shaft top portion 409, and a generally cylindrical shaft bottom portion 410, as can be seen in FIG. 4*c*.

FIG. 4*c* also shows more details of the shaft 402; specifically, a body bore 407 in body member 400 and a base bore 414 in base 404. Shaft bottom portion 410 is sized to fit securely into base bore 414 and may be secured by a pressed fit or by any appropritate securing means. Shaft top portion 409 is sized to fit securely into body bore 407 and may be secured by a pressed fit or by any appropriate securing means.

FIG. 4*b* is a perspective of face piece 10 inverted and shows generally the curvature of arcuated shoulder 405 as it relates to triangular surface 401. Additionally, the curvature of arcuated base 404 can be readily seen in FIG. 4*b*.

Since all components of all face pieces of the preferred embodiment of the invention are identical to all other face piece components, and since all components of all support members are identical to all other support member components, what is stated herein concerning a particular face piece or support member applies to all other face pieces or support members.

In the preferred embodiment, the radius of curvature on each arcuated component is determined utilizing the center of core member 12 as the point of origin of such radius.

Spherical core member 12 has certain radius of curvature depending upon the particular size of the invention. Arcuated base underside 413 of face piece 10 has a slightly larger radius of curvature than core member 12. Arcuated base top 411 of face piece 10 has a larger radius of curvature than arcuated base underside 413. Cap brim underside 310 of support member 13 has slightly larger radius of curvature than arcuated base top 411 of face piece 10. Cap brim top 308 of support member 13 has a larger radius of curvature than cap brim underside 310. Arcuated body underside 406 of face piece 10 has a slightly larger radius of curvature than cap brim top 308 of support member 13. These slight variations in radius of curvature facilitate movement of the face pieces and the interlocking mechanism of the invention.

The interlocking relationship of the face pieces and the support members can be seen in FIG. 2. Looking at support members 19 and 13, it can be seen that face piece 10 is slidably interlocked between support members 19, 13, and a third support member not shown in FIG. 2, but which can be seen in FIG. 3*a* as support member 87. Face piece 30 is slidably interlocked between support member 13, 17, and an additional support member not shown in FIG. 2, but which can be seen in FIG. 3*a* as support member 37. In a like manner, all face pieces of the preferred embodiment of the invention are slidably interlocked between three support members.

As shown in FIG. 2 and discussed previously, the curvature of the arcuated body underside 406 of face piece 10 generally conforms to the curvature of cap brim top 308 of support member 13 and the cap brim tops of support members 19 and 87 (not shown). Further, the curvature of arcuated base top 411 of face piece 10 generally conforms to the curvature of cap brim underside 310 of support member 13 and the cap brim undersides of support members 17 and 87 (not shown). Arcuated base underside 413 of face piece 10 has a curvature which generally conforms to the spherical surface of core member 12. As can be seen in FIG. 2 there is some slight free play between the above mentioned parts because of the differing radii of curvature to allow the face pieces to slide along the arcuated portions of the support members.

As a result of the interlocking relationship of the component parts discussed previously, it is possible to move the face pieces about the invention, changing their positions relative to one another and core member 12. However, in the preferred embodiment, it is anticipated that a simultaneous rotation would occur of any five face pieces having a common vertex or junction. For example, in FIG. 1 face pieces 10, 20, 30, 40, and 50 have a common vertex 15. Likewise, face pieces 30, 40, 60, 70, and 80 have a common vertex 85. Any five face pieces having a common vertex or junction are referred to as a single rotational unit. A rotational unit may be rotated in a clockwise or counterclockwise direction to change the relative positions of the face pieces to all other face pieces and the core member 12 in the invention.

In FIGS. 6*a* through 6*f* the operation of the invention is illustrated. To simplify the following description, the common vertices have been renumbered and therefore do not correspond to any figure heretofore disclosed. FIG. 6*a* shows the device in its pristine condition, or starting orientation. Common vertices 10, 11, and 12 are indicated as being on the backside of the device in FIG. 6*a*.

In FIG. 6*b* the top rotational unit made up of the five face pieces having common vertex 6 has been partially rotated counterclockwise. FIG. 6*c* shows one completed movement wherein the top five pieces now are in a second orientation to all other face pieces and the core member of the device. Note that vertices 5, 3, 2, and 9 in FIG. 6*a* are now "mixed" in FIG. 6*c*.

In FIG. 6*d* the lower right side rotational unit having common vertex 8 shown in FIG. 6*c* has been rotated one movement counterclockwise, resulting in a third orientation of all face pieces of the device. Next, FIG. 6*e* discloses the movement of the bottom rotational unit having common vertex 7, shown in FIG. 6*d* being rotated one movement counterclockwise providing yet a fourth orientation of all the face pieces of the device.

FIG. 6*f* shows an alternative movement following the orientation of FIG. 6*c*. Rather than rotating about common vertex 8 as shown in FIG. 6*d*, the device is rotated about the common vertex indicated by the arrow and having the numerals 5, 5, 3, 3, 3. Such a movement results in yet another orientation of all face pieces as shown in FIG. 6*f*.

As can be seen from the foregoing discussion, the number of alternative orientations is in the billions! By constructing the device with different colors, figures, or numerals on the face piece, there is presented a challenging combinatorial device which can be used for educational and/or entertainment purposes.

Figure 5:
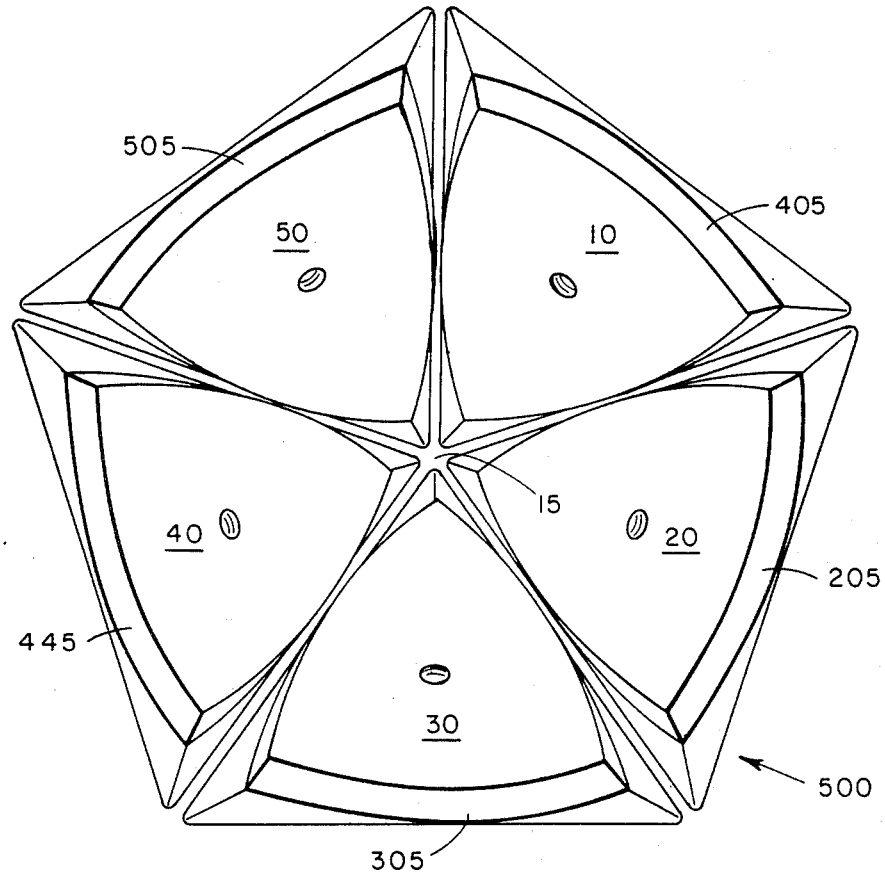
FIG. 5 is a perspective view of one rotational unit as viewed from the core member showing the rotational surface for the unit.

FIG. 5 illustrates an underside view of one rotational unit 500 as viewed from the core member. For reference purposes the common vertex is designated 15 and includes face pieces 10, 20, 30, 40, and 50. As has been previously discussed in describing face piece 10, an arcuated shoulder 405 is formed into the face piece. FIG. 5 shows, in bold black lines, a portion of the arcuated shoulder on each of the face pieces shown and referenced numerals 405, 205, 305, 445, and 505. The foregoing described arcuated shoulders form a segmented surface upon which the overall rotational unit 500 rotates when turned in a clockwise or counterclockwise direction. This overall segmented rotation surface slides across one side of the arcuated shoulders of adjacent face pieces not a part of the rotating unit 500.

As FIG. 5 shows, the segmented rotation surface formed by the side of each of the five arcuated shoulder portions 405, 205, 305, 445, and 505 of five face pieces 10, 20, 30, 40, and 50 having a common vertex 15 defines generally a portion of a cone which would have its vertex at the center of the core member 12. The particular construction of the arcuated shoulders yielding this conical configuration ensures that there is no binding of the face pieces during rotation and provides support for the rotating units during operation of the device.

Figure 7:
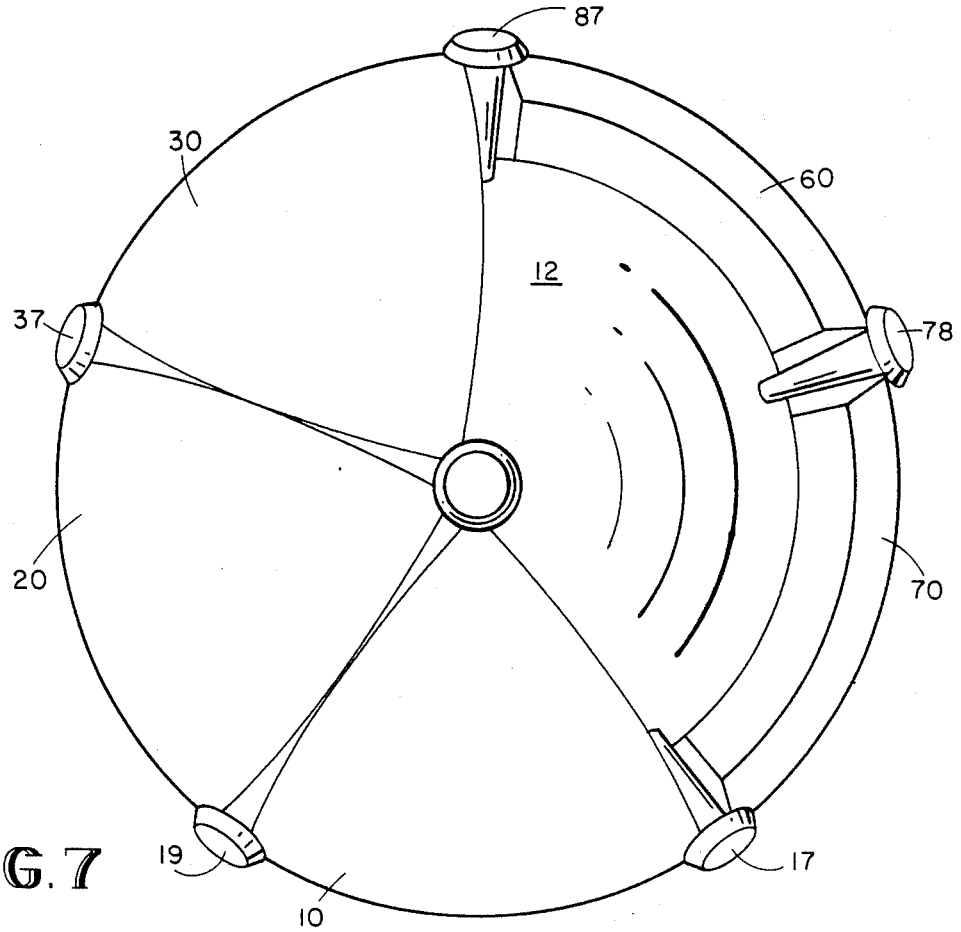
FIG. 7 is a perspective view an alternate embodiment of the invention with two face pieces removed.

FIG. 7 shows one alternate embodiment of the present invention wherein the face pieces 10, 20, 30, 60, and 70 rotate between the cap member of support members 19, 37, 17, 78, and 87 and core member 12. In the arrangement of FIG. 7, the face pieces do not have shafts or base portions, but are generally triangular in shape having arcuated shoulder portions as described in the preferred embodiment above. Any five adjacent face pieces having a common junction would form a rotational unit and would rotate upon a rotational surface as previously discussed in the preferred embodiment and the support members.

Figure 8:
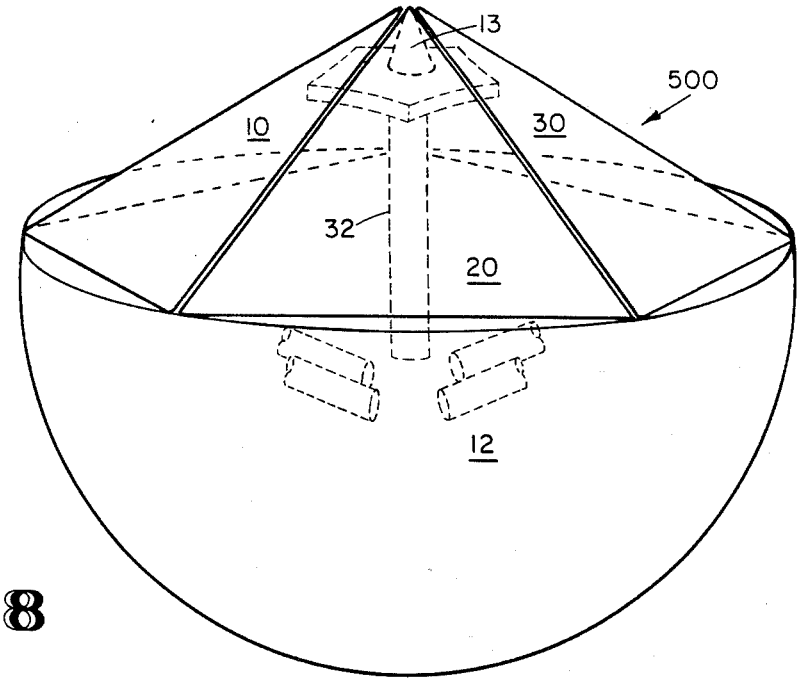
FIG. 8 is a view of yet another embodiment of the invention.

Other embodiments include combinatorial devices wherein there exist one or more rotational units and the remainder of the device is fixed in a given orientation. FIG. 8 illustrates such an embodiment with only one rotational unit 500. It is apparent that in the embodiment of FIG. 8 there are far less possible orientations of the face pieces about the core member 12 than with the preferred embodiment shown in FIGS. 1, 2, and 6. FIG. 8 shows face pieces 10, 20, and 30 along with only support member 13 attached to core member 12 by rod 32. The core member 12 of this alternative embodiment also functions as that portion of the embodiment having a fixed orientation. While only one support member is shown in FIG. 8, it is anticipated that a support member would be situated at the junction of each two adjacent face pieces and the fixed portion of the device. As in the preferred embodiment, each face piece would be slidably interlocked with these support members.

While the invention has been described in connection with the preferred embodiment, it is not intended to limit the invention to the particular forms set forth, but, on the contrary, it is intended to cover alternatives, modifications, and equivalents as may be included within the spirit and scope of the invention as defined by the appended claims.

I claim:

1. A three-dimensional combinatorial device comprising:

a core member;

a multiplicity of support members extending outwardly from said core member;

a multiplicity of face pieces having a first orientation about said core member, slidably interlocked with said support members such that any five of said face pieces having a common junction may be rotated about said core member as a unit resulting in a multiplicity of orientations of said face pieces, each of said face pieces being rotatable with respect to said core, each of said face pieces further having a generally triangular shoulder portion wherein one side of each of said generally triangular shoulder portions of said five face pieces of said rotating unit forms a rotation surface, wherein said rotation surface is rotatable upon one side of said generally triangular shoulder portious of a multiplicity of adjacent face pieces, said rotation surface defining generally a portion of a cone whose vertex is at the center of said core member.

2. A three-dimensional combinatorial device comprising:

a core member;

a multiplicity of support members extending radially from said core member; a multiplicity of identical, generally triangular face pieces having a first orientation about said core member, slidably interlocked with said support members such that any five of said triangular face pieces having a common vertex may be rotated about said core member as a unit, resulting in a multiplicity of orientations of said face pieces, each of said face pieces being rotatable with respect to said core, each of said face pieces further having a generally triangular shoulder portion wherein one side of each of said generally triangular shoulder portions of said five face pieces of said rotating units forms a rotation surface, wherein said rotation surface is rotatable upon one side of said generally triangular shoulder portions of a multiplicity of adjacent face pieces, said rotation surface defining generally a portion of a cone whose vertex is at the center of said core member.

3. The invention of claim 2 wherein each of said support members further comprises:

a support rod attached at a first end to said core member;

a cap member attached to said support rod at a second end, said cap member slidably interlocked with a multiplicity of said face pieces.

4. The invention of claim 3 wherein said shoulder portions slidably interlock between said cap members and said core member.

5. The invention of claim 2 wherein each of said support members further comprise an orientation means for ensuring said face pieces remain in a generally fixed spatial relationship to said core member.

6. The invention of claim 2 wherein each of said face pieces further comprise:

a shaft member attached at a first end to said generally triangular shoulder portion of said face pieces and at a second end attached to a base portion of said face pieces, said face pieces slidably interlocked with said support members between said shoulder portion and said base portion.

7. The invention of claim 2 wherein said multiplicity of support members is twelve in number and said multiplicity of said face pieces is twenty in number, said support members extending radially from said core members such that each of said support members is situated at the vertex of the junction of any adjacent five of said face pieces when in said first orientation.

8. The invention of claim 7 where any five of said twenty face pieces having a common vertex may be rotated about said core member as a unit resulting in a multiplicity of orientations of said face pieces.

9. A three dimensional combinatorial device comprising:

a spherical core member;

twelve support rods extending radially from said core member, each of said support rods having an arcuated cap member attached to one end of each of said support rods, the arcuation of said cap member generally conforming to but greater than the radius of curvature of said core member;

twenty identical face pieces having a first orientation about said core member, each of said face pieces having a shaft member attached at a first end to an arcuated shoulder portion of said face pieces and attached at a second end to an arcuated base portion of said face pieces, said face pieces slidably interlocked with said arcuated cap member between said shoulder portions and said base portions of said face pieces such that any adjacent five of said twenty face pieces having a common junction may rotate about said core member as a unit resulting in a multiplicity of orientations of said face pieces, said arcuation of said shoulder portion having a radius of curvature generally conforming to but greater than the radius of curvature of said spherical core member and said arcuated cap member, said arcuation of said base portion having a radius of curvature generally conforming to but greater than the radius of curvature of said spherical core member, but less than the radius of curvature of said cap member;

an orientation means on each of said cap members for ensuring said twenty face pieces remain in a generally fixed spatial relationship to said spherical core member, each of said orientation means being generally situated at said junction of any adjacent five face pieces when in said first orientation.

10. The invention of claim 9 wherein:

the angle between any two adjacent support rods is approximately 63°;

said face pieces are triangular in shape;

said arcuated shoulder portions are generally triangular in shape, one side of each of said generally triangular shoulder portions of any adjacent five face pieces having a common vertex forming a rotation surface wherein said rotation surface is rotatable upon one side of said shoulder portions of a multiplicity of adjacent face pieces.

11. A three-dimensional combinatorial device comprising:

a core member;

a multiplicity of non-rotatable support members extending radially from said core member;

a multiplicity of identical, generally triangular face pieces having a first orientation about said core member, slidably interlocked with said support members such that any five of said triangular face pieces having a common vertex may be rotated about said core member as a unit, resulting in a multiplicity of orientations of said face pieces, each of said face pieces being rotatable with respect to said core; said support members further comprising an orientation means for insuring said face pieces remain in a generally fixed spatial relationship to said core member.

* * * * *